US010024573B2

(12) United States Patent
Bailey

(10) Patent No.: US 10,024,573 B2
(45) Date of Patent: Jul. 17, 2018

(54) HEAT PUMP WATER HEATER APPLIANCE

(71) Applicant: Haier US Appliance Solutions, Inc., Wilmington, DE (US)

(72) Inventor: Thomas Allen Bailey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 101 days.

(21) Appl. No.: 15/209,828

(22) Filed: Jul. 14, 2016

(65) Prior Publication Data

US 2018/0017286 A1 Jan. 18, 2018

(51) Int. Cl.

| | |
|---|---|
| ***F24H 4/04*** | (2006.01) |
| ***F24H 9/02*** | (2006.01) |
| ***F24F 5/00*** | (2006.01) |
| *F24H 9/00* | (2006.01) |

(52) U.S. Cl.

CPC ..... *F24H 4/04* (2013.01); *F24F 5/0096* (2013.01); *F24H 9/02* (2013.01); *F24H 9/001* (2013.01)

(58) Field of Classification Search

CPC . F25B 30/02; Y02B 30/12; F24H 9/06; F24H 4/04

See application file for complete search history.

(56) References Cited

U.S. PATENT DOCUMENTS

| | | | | |
|---|---|---|---|---|
| 8,209,992 | B2 * | 7/2012 | Alden | F24F 5/0021 62/235.1 |
| 8,385,729 | B2 * | 2/2013 | Kleman | F24H 9/2021 392/308 |
| 8,647,375 | B2 * | 2/2014 | Woodall | A61F 7/0053 4/597 |
| 9,068,767 | B2 * | 6/2015 | Lesage | F25B 25/005 |
| 9,109,811 | B2 * | 8/2015 | Duplessis | F24H 4/04 |
| 2013/0043252 | A1 * | 2/2013 | Nelson | B21D 53/02 220/567.3 |
| 2013/0074786 | A1 * | 3/2013 | Lesage | F24H 1/36 122/17.1 |
| 2016/0201929 | A1 * | 7/2016 | Farris | F24D 19/1054 122/15.1 |
| 2017/0016631 | A1 * | 1/2017 | Shaffer | F24D 17/0036 |
| 2017/0284702 | A1 * | 10/2017 | Boros | F25B 13/00 |

FOREIGN PATENT DOCUMENTS

| | | |
|---|---|---|
| CN | 2809499 | 8/2006 |

* cited by examiner

*Primary Examiner* — Gregory A Wilson
(74) *Attorney, Agent, or Firm* — Dority & Manning, P.A.

(57) ABSTRACT

A water heater defines a vertical direction and includes a tank for holding water. The water heater further includes a shroud positioned over the tank along the vertical direction. The shroud defines a chamber over the tank, and includes a partition wall that divides the chamber into first and second chamber portions. The water heater includes an evaporator disposed within the first chamber portion, and a compressor disposed within the second chamber portion. The partition wall is positioned between the evaporator and compressor within the chamber of the shroud. Further, the shroud defines a vent extending through the shroud to the chamber of the shroud. In one embodiment, the vent is contiguous with the first chamber portion.

15 Claims, 6 Drawing Sheets

HEAT PUMP WATER HEATER APPLIANCE

FIELD OF THE INVENTION

The present subject matter relates generally to heat pump water heater appliances.

BACKGROUND OF THE INVENTION

Heat pump water heaters are gaining broader acceptance as a more economic and ecologically-friendly alternative to electric water heaters. These systems utilize a condenser configured in a heat exchange relationship with a water storage tank, for example wrapped around the tank in a series of coils. During operation of the vapor compression heat pump cycle, air flows across an evaporator and transfers energy to a refrigerant flowing through the evaporator. As such, the refrigerant exits the evaporator as a superheated vapor and/or high quality vapor mixture. Upon exiting the evaporator, the refrigerant enters a compressor where the pressure and temperature increase and the refrigerant becomes a superheated vapor. The superheated vapor from the compressor then enters the condenser, wherein the superheated vapor transfers energy to the water within a storage tank and returns to a saturated liquid and/or high quality liquid vapor mixture.

Certain heat pump water heaters include a shroud positioned over the water tank along the vertical direction. The shroud defines a chamber over the tank, and various components of the heat pump water heater, such as the compressor and evaporator, are disposed within the chamber. The shroud further includes a vent through which air enters the chamber and flows towards the evaporator. However, the airflow provided across the evaporator is frequently non-uniform because portions of the airflow are obstructed by other components, such as the compressor, positioned between the vent and the evaporator.

Accordingly, a heat pump water heater with features for improving airflow across the evaporator would be beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, a water heater defining a vertical direction is provided. The water heater includes a tank for holding water. The water heater further includes a shroud positioned over the tank along the vertical direction, wherein the shroud defines a chamber over the tank. The shroud includes a partition wall that divides the chamber into a first chamber portion and a second chamber portion. The water heater further includes an evaporator disposed within the first chamber portion, and a compressor disposed within the second chamber portion. The partition wall of the shroud is positioned between the evaporator and the compressor, and the shroud defines a vent extending through the shroud to the chamber of the shroud.

In a second exemplary embodiment, a water heater defining a vertical direction is provided. The water heater further includes a shroud positioned over the tank along the vertical direction, wherein the shroud defines a chamber over the tank. The shroud includes a partition wall that divides the chamber into a first chamber portion and a second chamber portion. The water heater includes an evaporator and a fan disposed within the first chamber portion, and a compressor disposed within the second chamber portion. The compressor is in fluid communication with the evaporator via a fluid conduit that extends through a slot formed in the partition wall. The partition wall is positioned between the evaporator and the compressor to restrict air flow between the first and second chamber portions. In addition, the shroud includes a cylindrical-shaped side wall that defines a vent contiguous with the first chamber portion of the chamber defined by the shroud.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
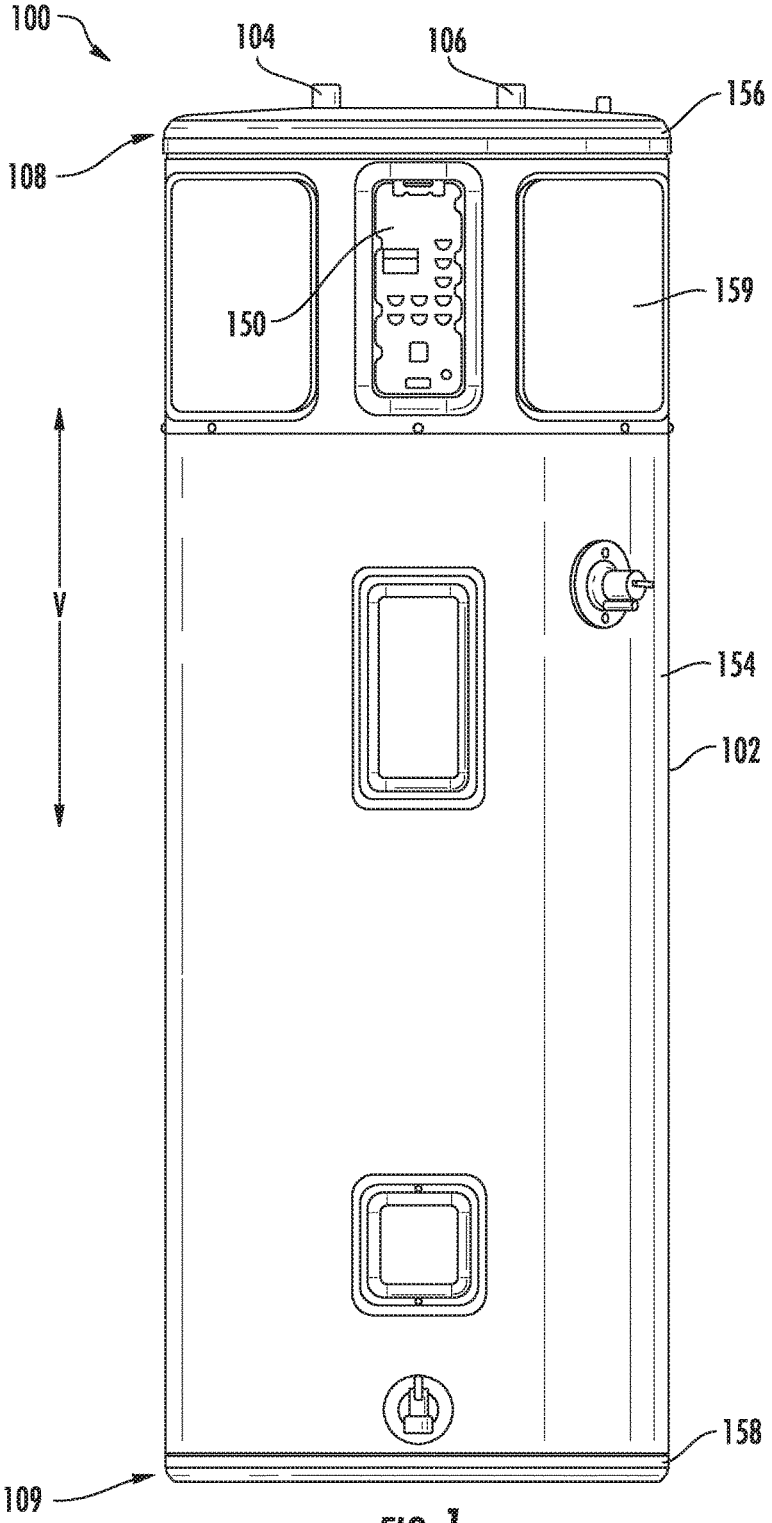
FIG. 1 provides a front elevation view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front elevation view of a water heater appliance 100 according to an exemplary embodiment of the present subject matter. Water heater appliance 100 includes an outer shell or casing 102. Casing 102 generally surrounds a tank 112 (FIG. 2) such that tank 112 is disposed within casing 102. Casing 102 may be formed from a variety of components. As illustrated, casing 102 may include a wrapper 154, one or more covers, such as a top cover 156 and a bottom cover 158, and a shroud 159 as illustrated. Shroud 159 may be positioned over tank 112 along vertical direction V such that shroud 159 defines a chamber 200 (FIG. 3) over tank 112. Additionally, covers 156, 158 may be fastened or coupled to wrapper 154 and shroud 159 to form casing 102.

Upper and lower heating elements 118, 119 (FIG. 2) and a sealed system 120 (FIG. 2) may also be positioned within casing 102 for heating water within tank 112. Upper and lower heating elements 118, 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater appliance 100 also includes an inlet or cold water conduit 104 and an outlet or hot water conduit 106 that are both in fluid communication with a chamber or interior volume 114 (FIG. 2) defined by tank 112. As an example, cold water from a water source, e.g., a municipal water supply or a well, can enter water heater appliance 100 through cold water conduit 104. From cold water conduit 104, such cold water can enter interior volume 114 of tank 112 wherein it is heated with heating elements 118, 119 and/or sealed system 120 to generate heated water. Such heated water can exit water heater appliance 100 at hot water conduit 106 and, e.g., be supplied to a bath, shower, sink, or any other suitable feature.

Water heater appliance 100 extends longitudinally between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100. It should be understood that water heater appliance 100 is provided by way of example only and that the present subject matter may be used with any suitable water heater appliance, including for example a heat pump water heater appliance.

Figure 2:
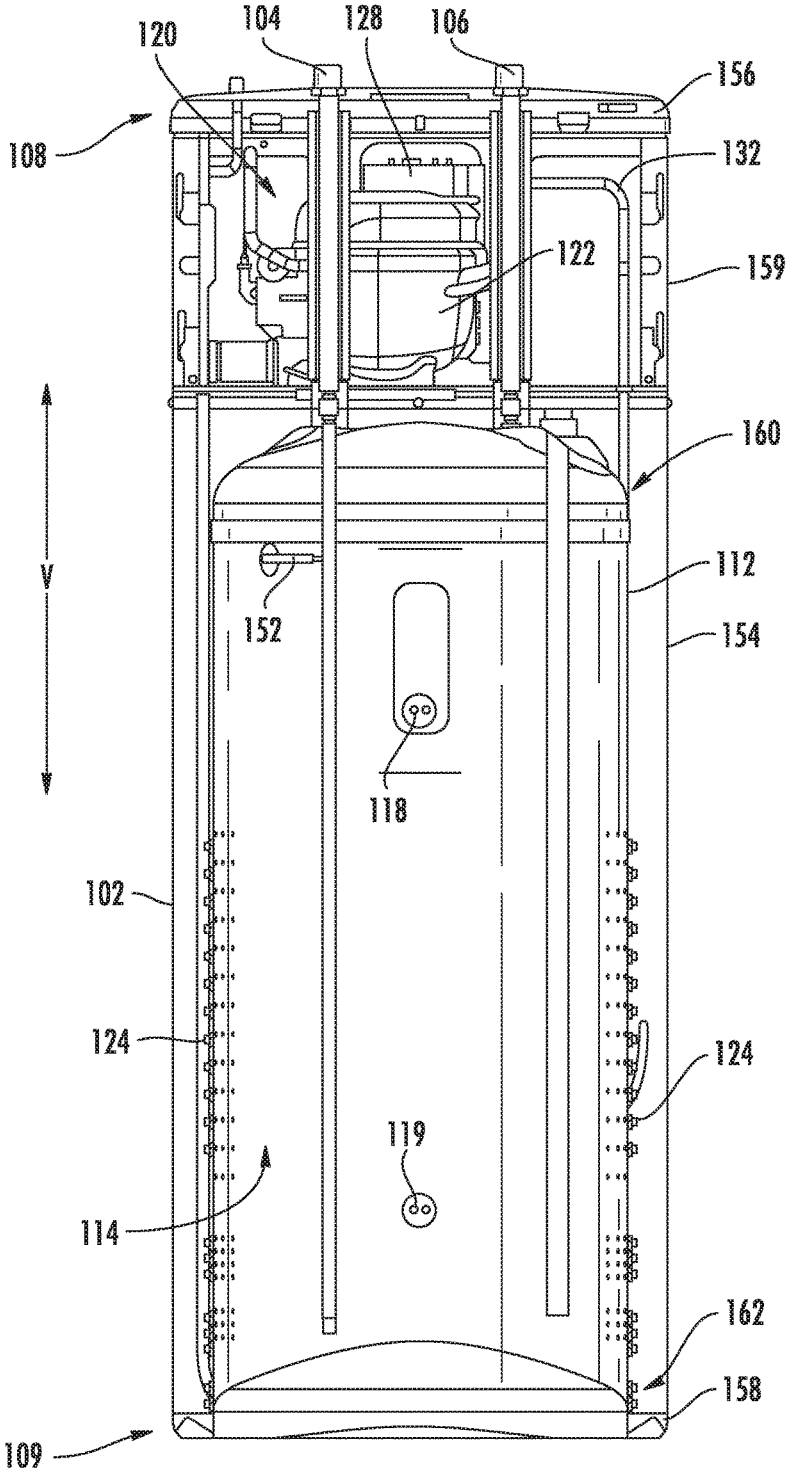
FIG. 2 provides a front section view of the exemplary water heater appliance of FIG. 1.

FIG. 2 provides a front section view of water heater appliance 100. As may be seen in FIG. 2, water heater appliance 100 includes sealed system 120 for heating water within interior volume 114 of tank 112. Sealed system 120 generally operates in a heat pump cycle. Thus, water heater appliance 100 is commonly referred to as a "heat pump water heater appliance." Water heater appliance 100 may additionally include one or more auxiliary heating elements, such as upper heating element 118 and/or lower heating element 119.

Sealed system 120 may include a compressor 122, a condenser 124 and an evaporator 128. Compressor 122 and/or evaporator 128 of sealed system 120 may be disposed within casing 102 at top portion 108 of water heater appliance 100, e.g., within shroud 159. As is generally understood, various conduits may be utilized to flow refrigerant between the various components of sealed system 120. Thus, e.g., evaporator 128 may be between and in fluid communication with condenser 124 and compressor 122. During operation of sealed system 120, refrigerant may flow from evaporator 128 through compressor 122. For example, refrigerant may exit evaporator 128 as a fluid in the form of a superheated vapor and/or high quality vapor mixture. Upon exiting evaporator 128, the refrigerant may enter compressor 122. Compressor 122 may be operable to compress the refrigerant. Accordingly, the pressure and temperature of the refrigerant may be increased in compressor 122 such that the refrigerant becomes a superheated vapor.

Condenser 124 may be assembled in a heat exchange relationship with tank 112 in order to heat water within interior volume 114 of tank 112 during operation of sealed system 120. In particular, condenser 124 may be positioned downstream of and in fluid communication with compressor 122, and may be operable to heat the water within interior volume 114 using energy from the refrigerant. For example, the superheated vapor from compressor 122 may enter condenser 124 wherein it transfers energy to the water within tank 112 and condenses into a saturated liquid and/or liquid vapor mixture.

Sealed system 120 may also include a throttling device 132 between condenser 124 and evaporator 128. Refrigerant, which may be in the form of high quality/saturated liquid vapor mixture, may exit condenser 124 and travel through throttling device 132 before flowing through evaporator 128. Throttling device 132 may generally expand the refrigerant, lowering the pressure and temperature thereof. The refrigerant may then be flowed through evaporator 128.

Throttling device 132 may be any suitable components for generally expanding the refrigerant. For example, in some exemplary embodiments, throttling device 132 may be a Joule-Thomson expansion valve, also known as a "J-T valve." In other exemplary embodiments, throttling device 132 may be an ejector. In still other exemplary embodiments, a capillary tube, fixed orifice, or other suitable apparatus may be utilized as throttling device 132.

Water heater appliance 100 may additionally include a temperature sensor 152. Temperature sensor 152 may be configured for measuring a temperature of water within interior volume 114 of tank 112. Temperature sensor 152 can be positioned at any suitable location within water heater appliance 100. For example, temperature sensor 152 may be positioned within interior volume 114 of tank 112 or may be mounted to tank 112 outside of interior volume 114 of tank 112. Temperature sensor 152 may further be positioned within upper portion 160 or lower portion 162. When mounted to tank 112 outside of interior volume 114 of tank 112, temperature sensor 152 can be configured for indirectly measuring the temperature of water within interior volume 114 of tank 112. For example, temperature sensor 152 can measure the temperature of tank 112 and correlate the temperature of tank 112 to the temperature of water within interior volume 114 of tank 112. Temperature sensor 152 may be any suitable temperature sensor. For example, temperature sensor 152 may be a thermocouple or a thermistor.

Water heater appliance 100 may further include a controller 150 that regulates operation of water heater appliance 100. Controller 150 may be, for example, in operative communication with sealed system 120 (such as compressor 122, and/or other components thereof), auxiliary heating elements, and/or temperature sensor 152. Thus, controller 150 can selectively activate system 120 and/or auxiliary heating elements in order to heat water within interior volume 114 of tank 112.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
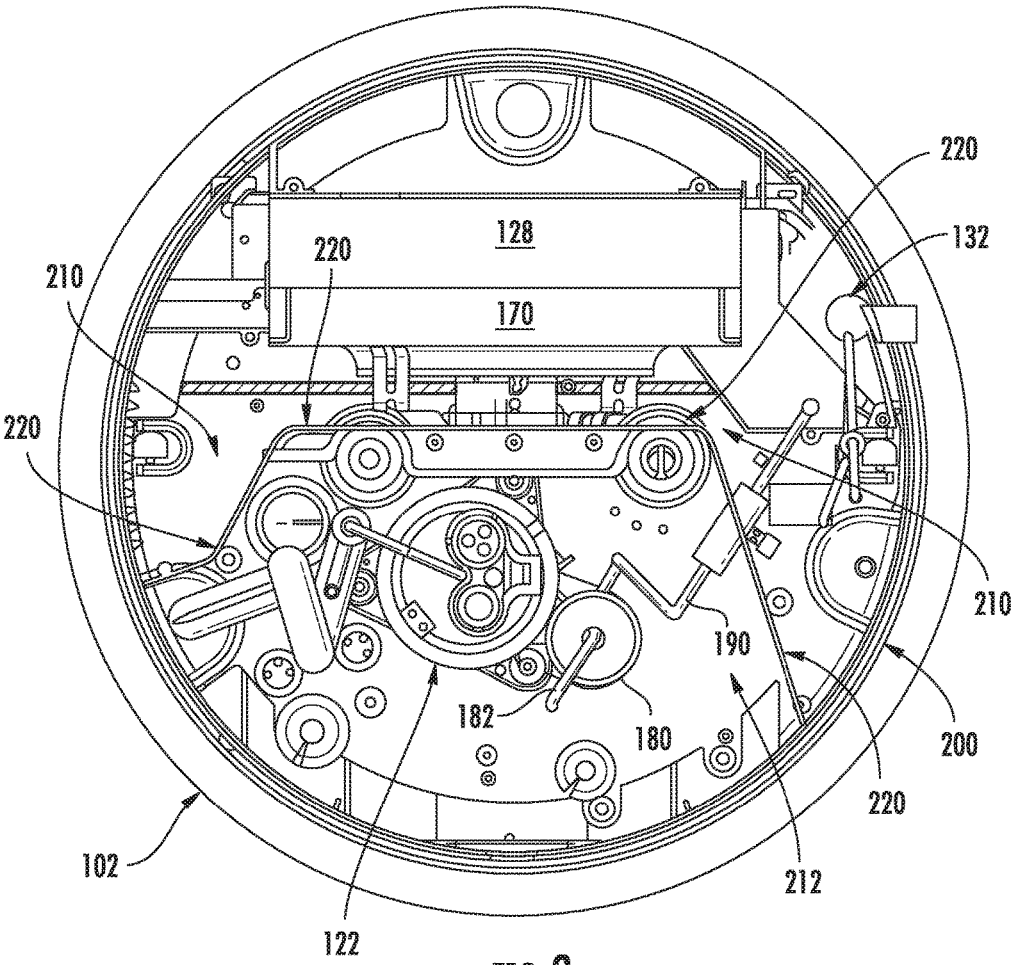
FIG. 3 provides a cutaway top view of a chamber formed over a tank of the exemplary water heater appliance of FIG. 1.

FIG. 3 of the present disclosure provides a plan view of chamber 200 defined by shroud 159 (FIG. 1). As shown, chamber 200 is divided into a first chamber portion 210 and a second chamber portion 212 by a partition wall 220 of shroud 200. More specifically, partition wall 220 restricts air flow between first and second chamber portions 210 and 212 within chamber 200 of shroud 159. In the embodiment shown, partition wall 220 is positioned between compressor 122 and evaporator 128 such that evaporator 128 is disposed within first chamber portion 210 and compressor 122 is disposed within second chamber portion 212. Thus, compressor 122 may be positioned opposite evaporator 128 about partition wall 220 within chamber 200 of shroud 159.

It should be appreciated that, in some embodiments, partition wall 220 may divide chamber 200 such that first chamber portion 210 is less than second chamber portion 212. In other embodiments, partition wall 220 may divide chamber 200 such that first chamber portion 210 is greater than second chamber portion 212. Alternatively, partition wall 220 may divide chamber 200 such that first chamber portion 210 is equal to second chamber portion 212.

First chamber portion 210 further includes a fan 170 that, in some exemplary embodiments, may be used to urge air into first chamber portion 210. Second chamber portion 212 further includes an accumulator 180 in fluid communication with compressor 122 via a fluid conduit 182 extending between accumulator 180 and compressor 122. Also, as shown in FIG. 3, throttling device 132 is disposed within first chamber portion 210. Still further, in the exemplary embodiment shown in FIG. 3, evaporator 128 is in fluid communication with compressor 122 via a fluid conduit 190 that extends between first chamber portion 210 and second chamber portion 212. More specifically, fluid conduit 190 extends through partition wall 220 which, as discussed below in more detail and shown in FIG. 6, may include a slot 452 (FIG. 6) through which fluid conduit 190 passes.

It should be appreciated that, in other embodiments, partition wall 220 may define an aperture through which fluid conduit 190 passes. Additionally, aperture may include a seal member (not shown) that circumferentially surrounds fluid conduit 190 at the aperture to restrict airflow between first and second chamber portions 210 and 212.

Figure 4:
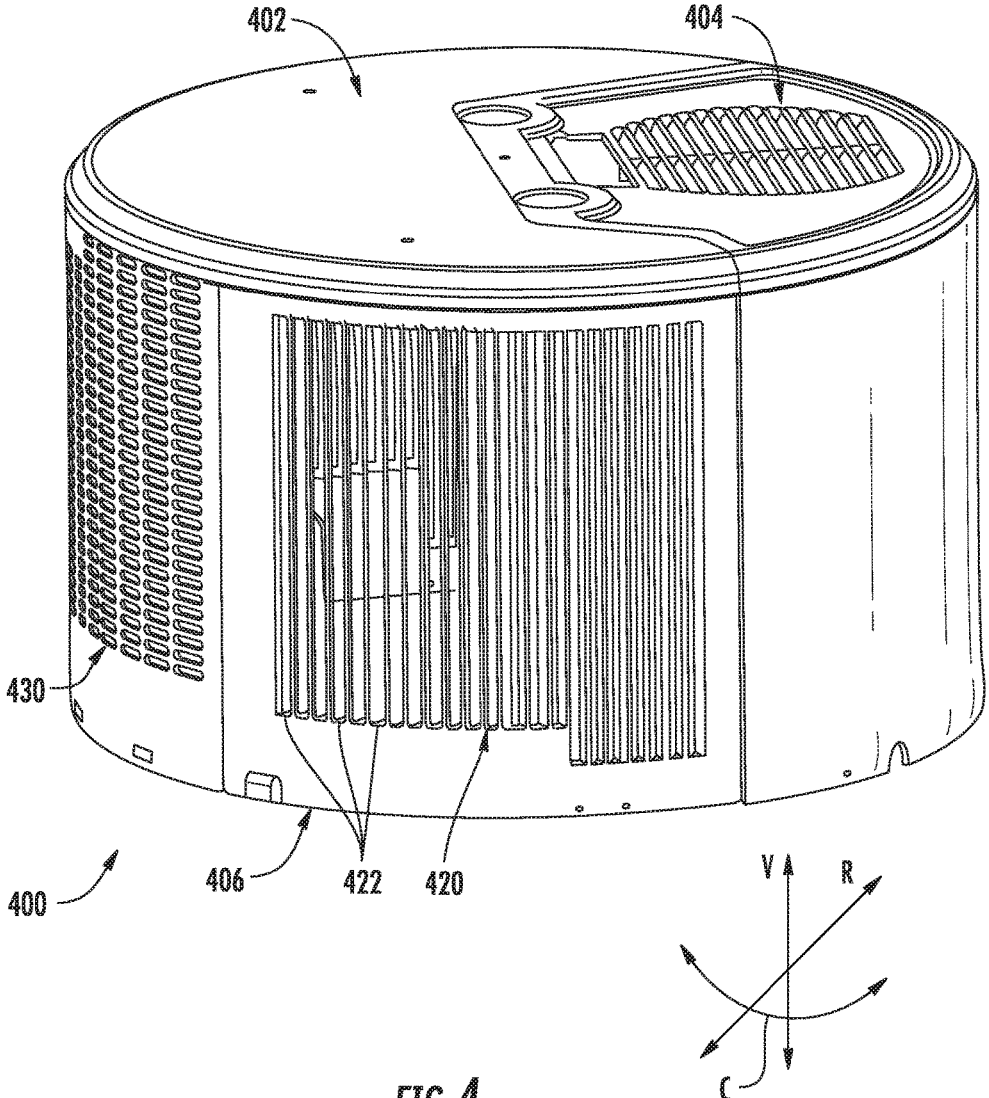
FIG. 4 provides a side view of a shroud according to an exemplary embodiment of the present disclosure.
Figure 5:
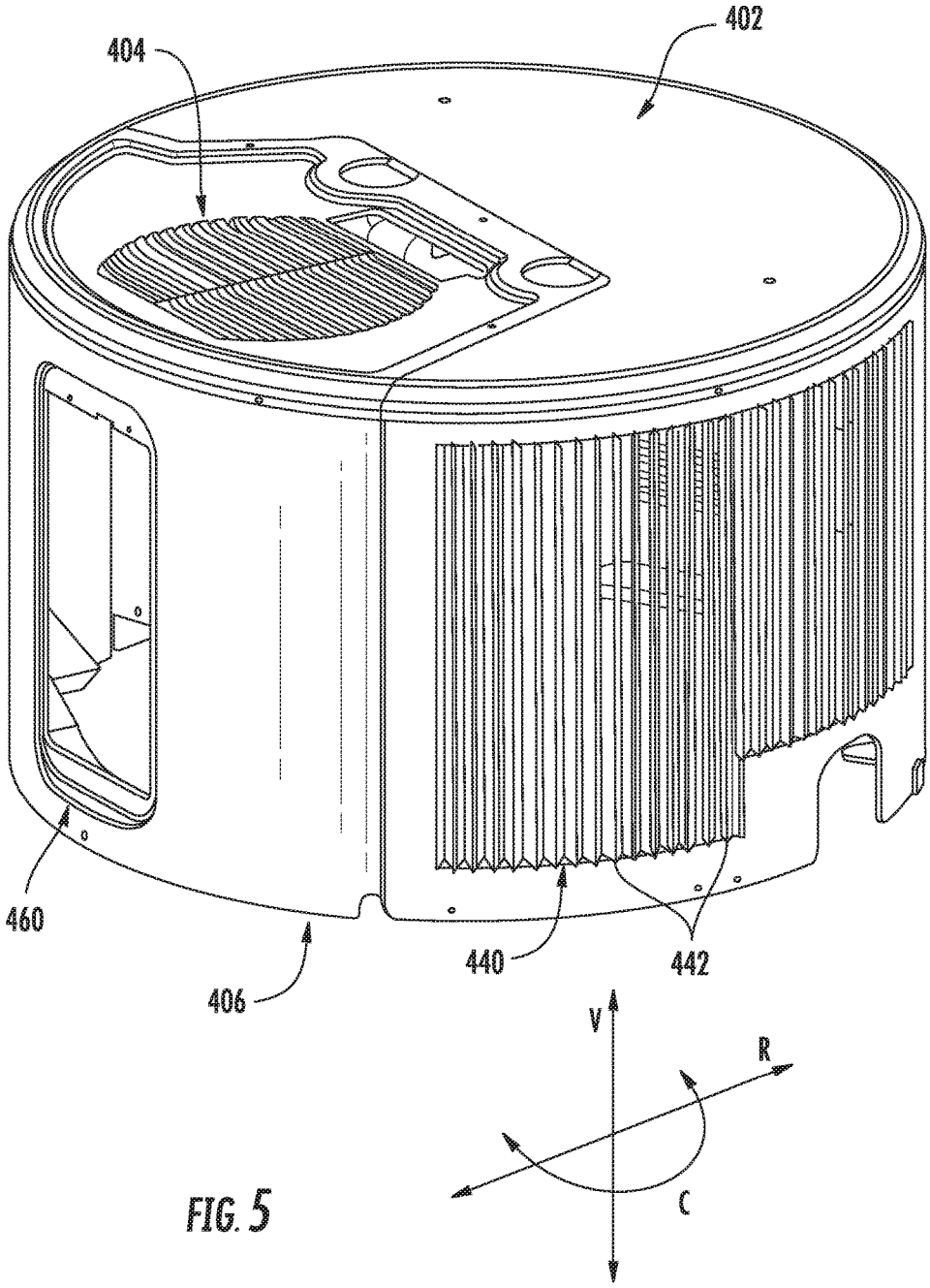
FIG. 5 provides another side view of the exemplary shroud depicted in FIG. 4.

FIGS. 4 and 5 depict side views of a shroud 400 according to an exemplary embodiment of the present subject matter. As an example, shroud 400 may be utilized in water heater appliance 100 as shroud 159. Thus, shroud 400 is described in greater detail below in the context of water heater appliance 100. In alternative exemplary embodiments, shroud 400 may be used in any other suitable water heater appliance.

As shown, shroud 400 defines a circumferential direction C, a vertical direction V, and a radial direction R that is perpendicular to vertical direction V. Shroud 400 includes a top wall 402 that defines a vent 404. In some exemplary embodiments, vent 404 extends through top wall 402 and is positioned over second chamber portion 212 along vertical direction V. Further, in some embodiments, vent 404 may provide a flow path through top wall 402 for air to exit second chamber portion 212. For example, hot air from compressor 122 may flow along vertical direction V and exit second chamber portion 212 at top wall 402 through vent 404.

Shroud 400 also includes a side wall 406. Side wall 406 defines a cylindrical shape and extends downwardly from top wall 402 along vertical direction V, e.g., to wrapper 154. Side wall 406 further defines a first vent 420 and a second vent 440. First and second vents 420 and 440 extend through side wall 406 and provide a path for air (not shown) through side wall 406 to enter first chamber portion 210. Also, although first and second vents 420 and 440 are shown as having slats 422 and 442 extending along vertical direction V on side wall 406, it should be appreciated that slats 422 and 442 may have any suitable orientation. For example, slats 422 and 442 may extend along circumferential direction C of side wall 406.

It should be appreciated that, in other exemplary embodiments, shroud 400 may include only one vent on side wall 406. For example, side wall 406 may include first vent 420 that extends around a portion of side wall 406 that is contiguous with or positioned at first chamber portion 210. More specifically, first vent 420 may extend around the portion of side wall 406 for at least one-hundred and eighty degrees along the circumferential direction C. Further, in such embodiments, first vent 420 may provide both an intake and exhaust flow path for air. In another exemplary embodiment, first vent 420 may extend around the portion of side wall 406 for between approximately ninety degrees and approximately one-hundred and eighty degrees along the circumferential direction C. Alternatively, first vent 420 may extend between approximately five degrees and approximately ninety degrees. As used herein, the term "approximately" means within three degrees of the stated degree when used in the context of angles.

Figure 6:
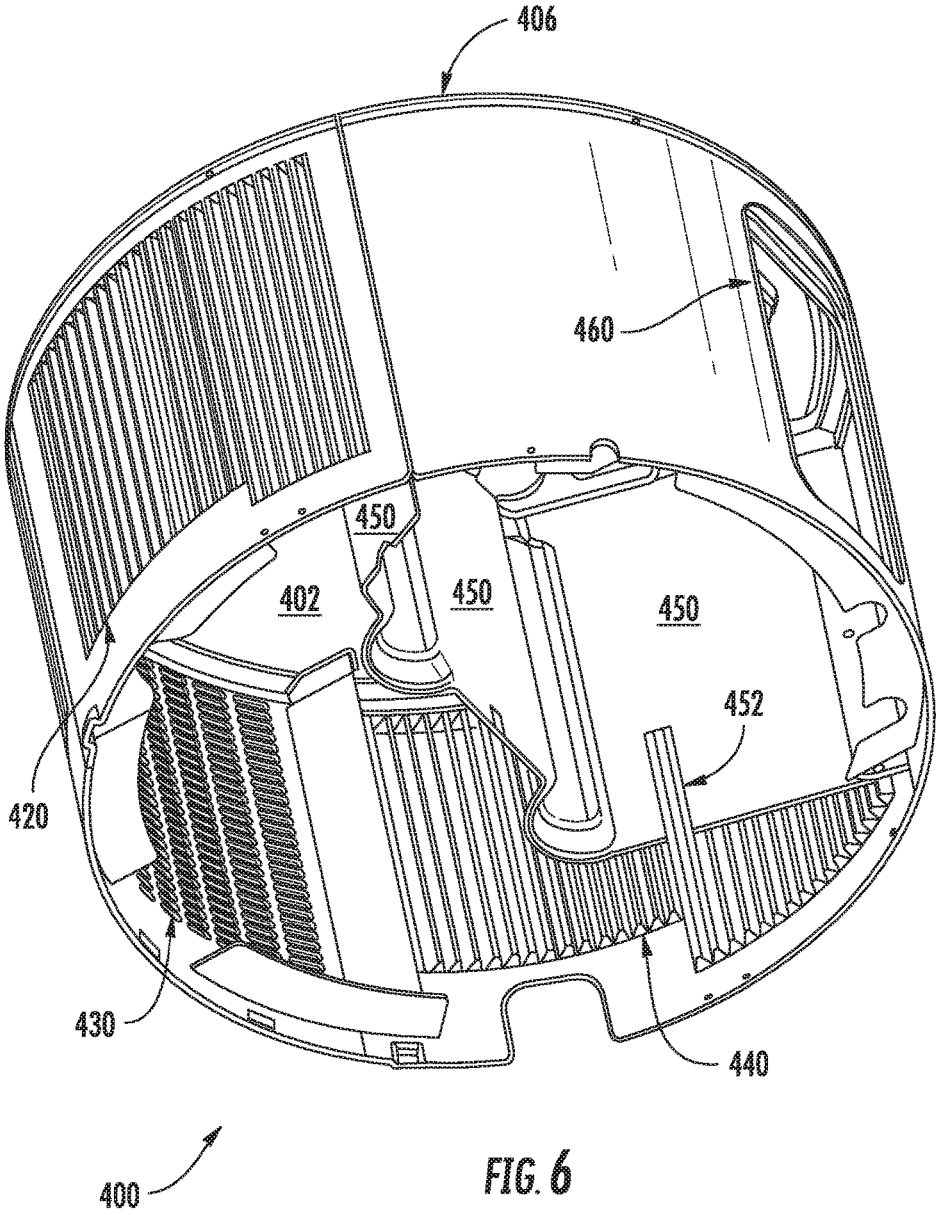
FIG. 6 provides a perspective bottom view of the exemplary shroud depicted in FIG. 4.

In the exemplary embodiment of shroud 400 shown FIGS. 4-6, side wall 406 defines an exhaust vent 430 positioned between first vent 420 and second vent 440. Exhaust vent 430 provides a flow path for air to leave first chamber portion 210 through side wall 406. More specifically, exhaust vent 430 may be sized and oriented such that air exits first chamber portion 210 after flowing across evaporator 128.

Referring now to FIGS. 3 and 6, shroud 400 includes a partition wall 450, such as a bent sheet metal partition wall, that is surrounded by side wall 406 and extends downwardly from top wall 402 along vertical direction V. As shown, partition wall 450 divides chamber 200 into first chamber portion 210 and second chamber portion 212. Evaporator 128 is disposed within first chamber portion 210 and compressor 122 is disposed within second chamber portion 212. Further, partition wall 450 restricts airflow between first and second chamber portions 210 and 212 such that air entering first chamber portion 210 through first and second vents 420 and 440 cannot flow into second chamber portion 212 through partition wall 450. Thus, partition wall 450 restricts air flow between first and second chamber portions 210, 212 within chamber 200 of shroud 400. Still further, partition wall 450 may be comprised of insulating material, such as foam or fiberglass insulation, that reduces heat transfer between the first chamber portion 210 and the second chamber portion 212. Partition wall 450 may also be shaped to receive cold water conduit 104 and/or hot water conduit 106. Thus, cold water conduit 104 and/or hot water conduit 106 may be positioned on or at partition wall 450.

Partition wall 450 defines slot 452 through which fluid conduit 190 passes while extending between first and second chamber portions 210 and 212. Further, side wall 406 of shroud 400 defines an aperture 460 for a controller. For example, controller 150 depicted above in FIG. 1 may be received in aperture 460.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater defining a vertical direction, the water heater comprising:

a tank for holding water;

a shroud positioned over the tank along the vertical direction, the shroud defining a chamber over the tank, the shroud including a partition wall dividing the chamber into a first chamber portion and a second chamber portion, the shroud defining a first vent and a second vent, the first vent and the second vent both extending through the shroud to the chamber of the shroud, the first vent defined at a side wall of the shroud, the second vent defined at a top wall of the shroud;

an evaporator disposed within the first chamber portion; and a compressor disposed within the second chamber portion, wherein the partition wall is positioned between the evaporator and the compressor within the chamber of the shroud.

2. The water heater of claim 1, wherein the first vent provides a flow path for air to enter the first chamber portion.

3. The water heater of claim 2, further comprising a fan disposed within the first chamber portion, the fan operable to urge air into the first chamber portion through the first vent.

4. The water heater of claim 2, wherein the side wall defines a cylindrical shape.

5. The water heater of claim 4, wherein the first vent extends around the side wall for at least ninety degrees.

6. The water heater of claim 4, wherein the first vent extends around the side wall for at least one hundred and eighty degrees.

7. The water heater of claim 1, wherein the second vent is positioned over the second chamber portion along the vertical direction.

8. A water heater defining a vertical direction, the water heater comprising:

a tank for holding water;

a shroud positioned over the tank along the vertical direction, the shroud and the tank collectively defining a chamber, the shroud including a partition wall dividing the chamber into a first chamber portion and a second chamber portion;

an evaporator disposed within the first chamber portion;

a fan disposed within the first chamber portion; and a compressor disposed within the second chamber portion wherein the partition wall is positioned between the evaporator and the compressor such that the partition wall restricts air flow between the first and second chamber portions within the chamber of the shroud, wherein a cylindrical-shaped side wall of the shroud defines a vent contiguous with the first chamber portion.

9. The water heater of claim 8, wherein the vent defined at the cylindrical-shaped side wall extends around the cylindrical-shaped side wall for at least ninety degrees.

10. The water heater of claim 8, wherein the vent defined at the cylindrical-shaped side wall extends around the cylindrical-shaped side wall for at least one hundred and eighty degrees.

11. The water heater of claim 8, further comprising a vent defined at a top portion of the shroud.

12. The water heater of claim 11, wherein the vent defined at the top portion of the shroud is positioned over the second chamber portion along the vertical direction.

13. The water heater of claim 8, further comprising an expansion valve disposed within the first chamber portion.

14. The water heater of claim 8, wherein the fan is operable to urge air into the first chamber portion through the vent.

15. The water heater of claim 8, wherein the partition wall comprises an insulating material to reduce heat transfer between the first chamber portion and the second chamber portion.

* * * * *